US007105783B2

(12) United States Patent
Takagi et al.

(10) Patent No.: US 7,105,783 B2
(45) Date of Patent: Sep. 12, 2006

(54) FIXING DEVICE USING INDUCTION HEATING

(75) Inventors: Osamu Takagi, Tokyo (JP); Kazuhiko Kikuchi, Yokohama (JP); Akihiro Wasai, Mishima (JP)

(73) Assignees: Kabuhsiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/806,392

(22) Filed: Mar. 23, 2004

(65) Prior Publication Data

US 2004/0188421 A1 Sep. 30, 2004

(30) Foreign Application Priority Data

Mar. 25, 2003 (JP) ..... 2003-082919
Mar. 25, 2003 (JP) ..... 2003-082920
Mar. 25, 2003 (JP) ..... 2003-083655
Mar. 25, 2003 (JP) ..... 2003-083782

(51) Int. Cl.
*H05B 6/14* (2006.01)
*G03G 15/20* (2006.01)
*H05B 6/08* (2006.01)

(52) U.S. Cl. ..... 219/619; 219/676; 219/656; 399/328; 399/330

(58) Field of Classification Search ..... 219/619, 219/676, 656, 662, 671–674; 399/328–338
See application file for complete search history.

(56) References Cited

U.S. PATENT DOCUMENTS 4,891,484 A * 1/1990 Waggott et al. ..... 219/645
5,822,669 A * 10/1998 Okabayashi et al. ..... 399/330
6,337,969 B1 1/2002 Takagi et al.
6,415,128 B1 7/2002 Takagi et al.
6,522,846 B1 2/2003 Kinouchi et al.
2003/0002882 A1* 1/2003 Takagi et al. ..... 399/69

FOREIGN PATENT DOCUMENTS

JP 2001-312165 A 11/2001

OTHER PUBLICATIONS

U.S. Appl. No. 10/154,970, filed May 28, 2002, Takagi et al.
U.S. Appl. No. 10/290,296, filed Nov. 8, 2002, Kinouchi et al.
U.S. Appl. No. 10/807,366, filed Mar. 24, 2004, Wasai et al.
U.S. Appl. No. 10/807,428, filed Mar. 24, 2004, Kikuchi et al.
U.S. Appl. No. 10/445,210, filed May 27, 2003, Kinouchi et al.
U.S. Appl. No. 10/126,618, filed Apr. 22, 2002, Kikuchi et al.
U.S. Appl. No. 10/872,472, filed Jun. 22, 2004, Kinouchi et al.

(Continued)

*Primary Examiner*—Philip H. Leung
(74) *Attorney, Agent, or Firm*—Foley & Lardner LLP

(57) ABSTRACT

In a fixing device according to this invention, coils are formed on a coil bobbin having a predetermined shape at an induction heating portion including a plurality of coils. In order to minimize the temperature difference of a heating roller in the axial direction, the coil bobbin has a shape for holding the interval between the coils at a predetermined interval.

15 Claims, 14 Drawing Sheets

OTHER PUBLICATIONS

U.S. Appl. No. 10/455,419, filed Jun. 6, 2003, Takagi et al.
U.S. Appl. No. 10/143,909, filed May 14, 2002, Kinouchi et al.
U.S. Appl. No. 10/391,621, filed Mar. 20, 2003, Wasai.

* cited by examiner

FIXING DEVICE USING INDUCTION HEATING

CROSS-REFERENCE TO RELATED APPLICATIONS

This application is based upon and claims the benefit of priority from prior Japanese Patent Applications No. 2003-082919, filed Mar. 25, 2003; No. 2003-082920, filed Mar. 25, 2003; No. 2003-083655, filed Mar. 25, 2003; and No. 2003-083782, filed Mar. 25, 2003, the entire contents of all of which are incorporated herein by reference.

BACKGROUND OF THE INVENTION

1. Field of the Invention

The present invention relates to a fixing device which is mounted in an image forming apparatus such as a copying machine or printer and fixes a developer image on a paper sheet.

2. Description of the Related Art

Conventionally, an image forming apparatus such as an electrophotographic copying machine utilizing a digital technique comprises a fixing device which fixes a developer image onto a paper sheet by heating in a press state.

The heat source of the heating roller of the fixing device is induction heating. In induction heating, a coil is stored in the heating roller and connected to a capacitance to form a resonant circuit. One resonant circuit is excited at one frequency. A high-frequency current is supplied to the coil to generate a high-frequency magnetic field from the coil. The high-frequency magnetic field causes the heating roller to generate an eddy current. Joule heat by the eddy current causes self-heating of the heating roller.

In recent years, a short warming-up time presents a technical issue as an energy-saving technique. The measure is to decrease the diameter of the heating roller.

The electrophotographic copying machine uses various paper sizes. When small-width paper sheets are successively fed to the fixing device, a portion of the heating roller extending from the paper becomes higher in temperature than a portion within the paper width because it is not deprived of heat by the paper sheet. When a large-width paper sheet is fed after a small-width paper sheet, a fixing error occurs due to a high-temperature offset. This phenomenon is prominent for a smaller-diameter heating roller (smaller heat capacity).

BRIEF SUMMARY OF THE INVENTION

According to an aspect of the present invention, there is provided a fixing device comprising:

a coil unit which holds a coil having a predetermined number of turns;

a coil assembly which includes at least two coil units; and a heating member which generates heat by an eddy current upon a change in a magnetic field generated by an induction heating coil of the coil assembly.

According to another aspect of the present invention, there is provided a fixing device comprising:

a coil unit which holds a coil having a predetermined number of turns;

a coil body which includes at least two coil units and includes an induction heating coil formed by a plurality of series- or parallel-connected coils;

a coil assembly which includes at least two coil bodies;

a heating member which generates heat by an eddy current upon a change in a magnetic field generated by the induction heating coil; and a power supply mechanism which supplies high-frequency power to the induction heating coil.

According to further another aspect of the present invention, there is provided a fixing device comprising:

a heating device including a core, a plurality of coil holding bodies, a plurality of coil bodies, and a metal body, the core having a plurality of grooves extending in an axial direction, the coil holding bodies each having an outer surface and an inner surface and having a predetermined length outside the core in the axial direction, the coil bodies each being wound around the outer surface of the coil holding body in a predetermined direction, receiving a voltage and a current at a predetermined frequency to generate a magnetic field, and having one end connected to a power supply via an arbitrary groove of the core and the other end connected to the power supply via a remaining groove of the core, and the metal body being positioned around the coil body so as to generate an eddy current in accordance with the magnetic field provided by the coil body;

a power supply device which supplies the voltage and the current at the predetermined frequency to the coil body; and a press member which provides a predetermined pressure to the metal body.

Additional objects and advantages of the invention will be set forth in the description which follows, and in part will be obvious from the description, or may be learned by practice of the invention. The objects and advantages of the invention may be realized and obtained by means of the instrumetalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Preferred embodiments of the present invention will be described below with reference to the several views of the accompanying drawing.

Figure 1:
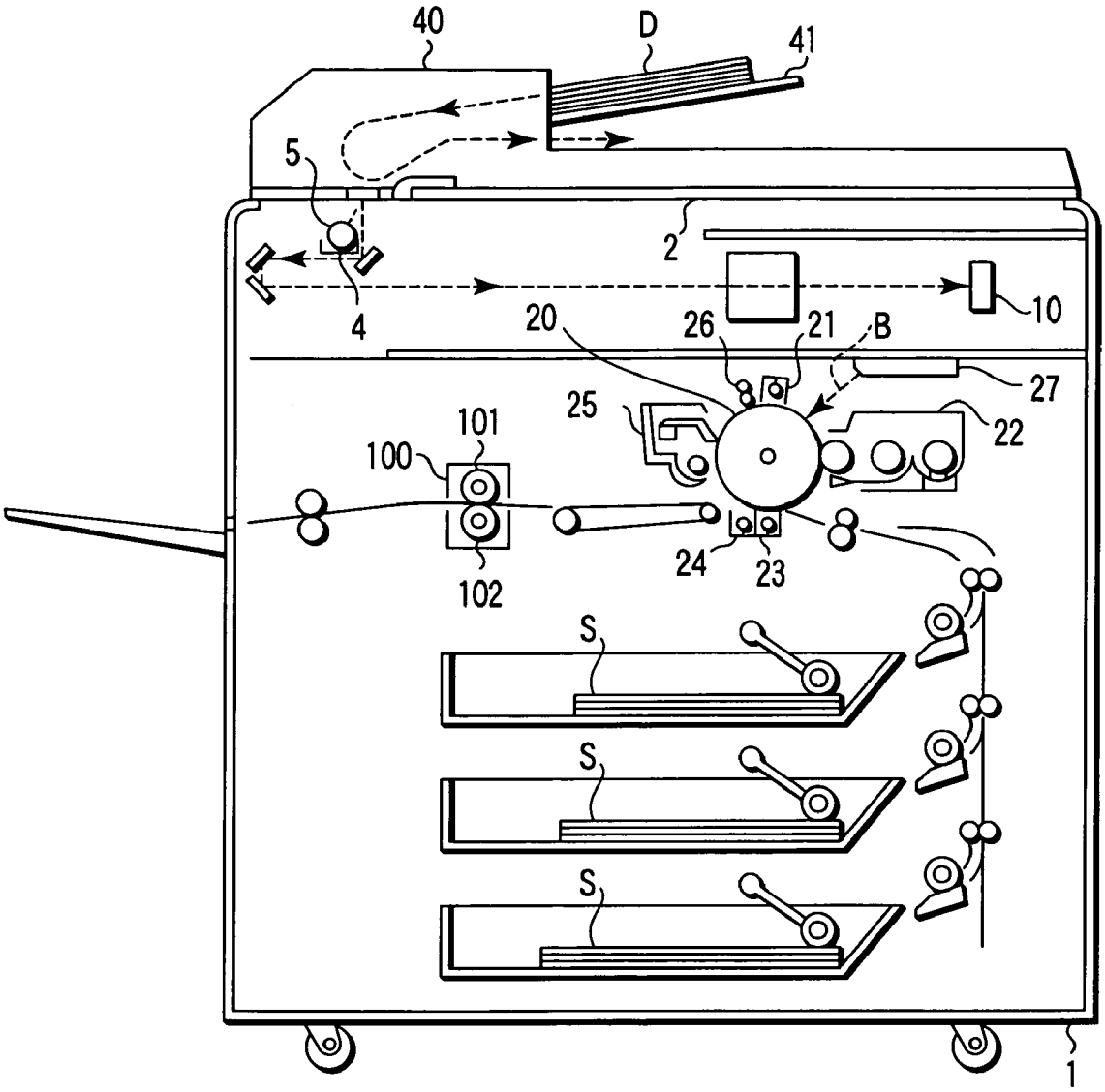
FIG. 1 is a schematic view showing an image forming apparatus which incorporates a fixing device to which an embodiment of the present invention can be applied.

FIG. 1 shows an example of a multifunction copying machine 1 as an image forming apparatus. A document table (glass plate) 2 on which a document D is set is arranged on the upper surface of the multifunction copying machine 1. The document D set on the document table 2 is illuminated with illumination light from an illumination exposure lamp 5 of a carriage 4 which is movably arranged along the document table 2.

Light reflected by the document D is photoelectrically converted by a photoelectric conversion element 10 such as a CCD (Charge Coupled Device). An image signal output from the CCD 10 is supplied to a laser unit 27. A laser beam B from the laser unit 27 illuminates a photosensitive body 20 (to be described below).

The photosensitive drum 20 is arranged at a predetermined position within the copying machine 1. By irradiating the photosensitive drum 20 with light while charging it, the drum 20 can hold a latent image.

The photosensitive drum 20 is sequentially surrounded by a charging unit 21, developing unit 22, transfer unit 23, separation unit 24, cleaner 25, charge removing unit 26, and the like. Although not described in detail, a latent image is formed on the photosensitive drum 20 by the laser beam B from the laser unit 27. The latent image formed on the photo-sensitive drum 20 is developed by toner selectively supplied from the developing unit, and transferred onto a copying sheet supplied at a predetermined timing. The toner transferred to the copying sheet is fixed onto the copying sheet by a fixing device 100 (to be described later).

Figure 2:
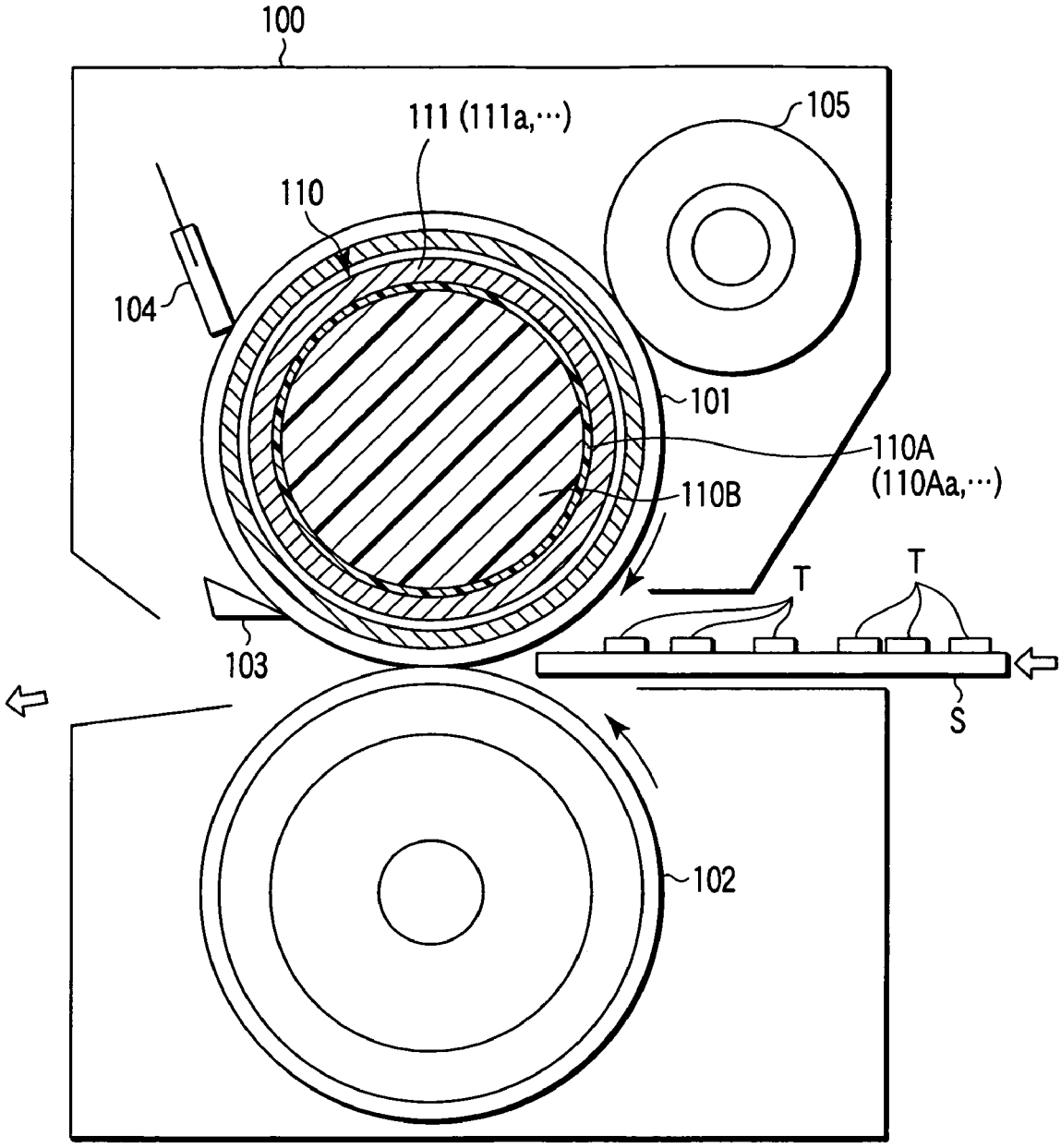
FIG. 2 is a schematic view showing an example of the fixing device to which the embodiment of the present invention can be applied.

FIG. 2 shows an example of the fixing device which can be mounted in the image forming apparatus shown in FIG. 1.

As shown in FIG. 2, the fixing device 100 comprises a heating roller 101 and press roller 102 at positions where these rollers vertically sandwich the convey path of a copying sheet S. The press roller 102 is in press contact with the outer surface of the heating roller 101 by a press mechanism (not shown). The contact between these rollers 101 and 102 has a predetermined nip width.

The heating roller 101 is constituted by forming a conductive material such as iron into a cylindrical shape and coating the outer surface of the iron cylinder with a mold release layer containing fluoroplastic such as a tetrafluoroethylene resin. The heating roller 101 is rotated and driven right in FIG. 2 by a driving motor (not shown). The press roller 102 rotates left in FIG. 2 in response to rotation of the heating roller 101. The copying sheet S passes through the contact between the heating roller 101 and the press roller 102. The copying sheet receives heat from the heating roller 101 to fix onto the copying sheet S a developer image T on the copying sheet S.

The heating roller 101 is surrounded by a separation claw 103 for separating the copying sheet S from the heating roller 101, a cleaning member 104 for removing toner, paper dust, and the like from the heating roller 101, and a coating roller 105 for coating the surface of the heating roller 101 with a mold release agent.

The heating roller 101 incorporates an induction heating portion 110 for induction heating. The induction heating portion 110 has a coil bobbin 110A whose outer surface is wound with a wire serving as a coil 111, and a holding member 110B which holds the coil bobbin 110A. When the coil 111 is formed by a plurality of coils (111*a*, . . . ), the coil bobbin 110A is formed by a plurality of coil bobbins 110A (110A*a*, . . . ) in correspondence with the number of coils. The induction heating portion 110 receives high-frequency power from a high-frequency circuit (to be described later), and generates a high-frequency magnetic field for induction heating. The high-frequency magnetic field generates an eddy current in the heating roller 101, and Joule heat by the eddy current causes self-heating of the heating roller 101.

Figure 3:
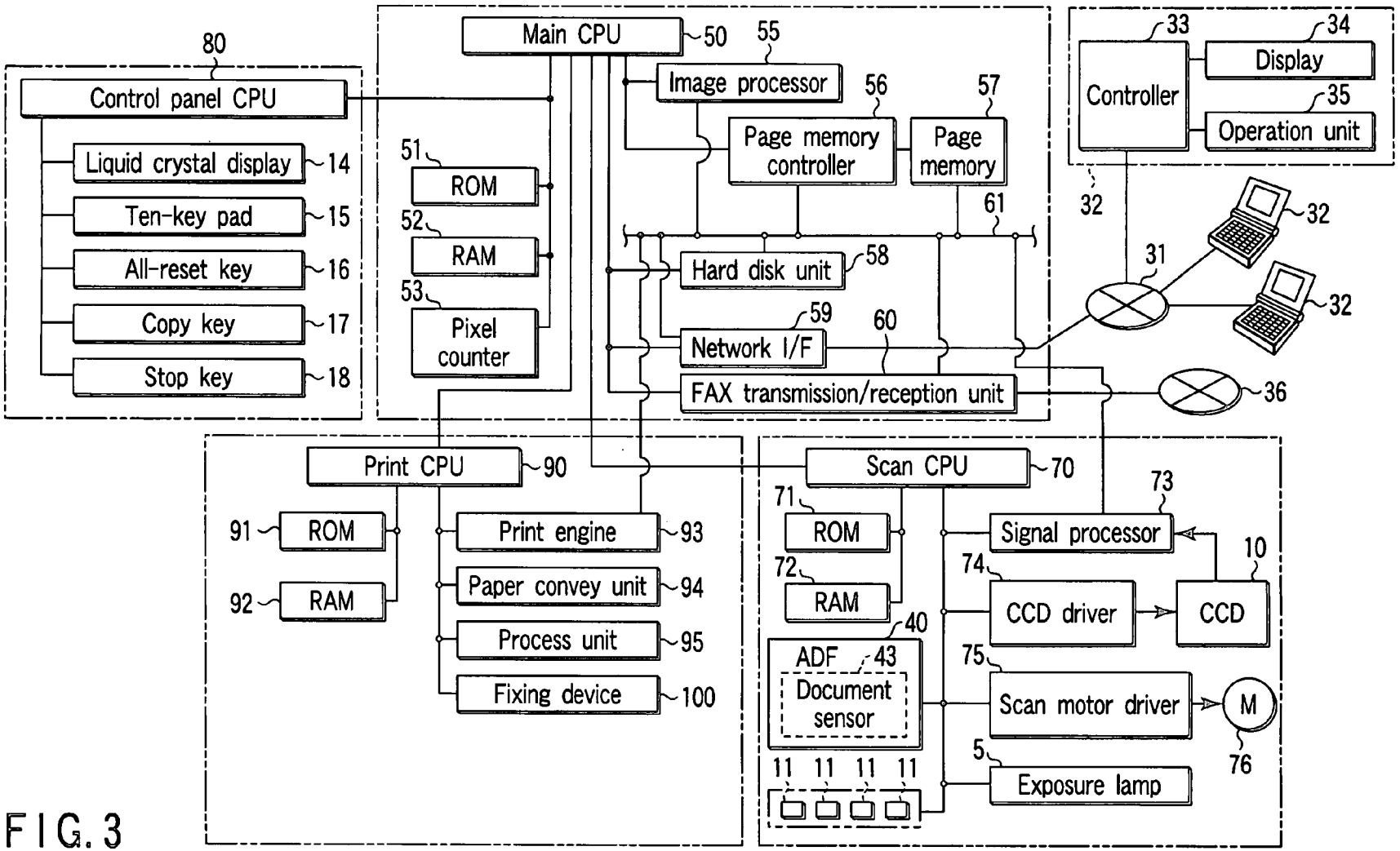
FIG. 3 is a block diagram for explaining the control system of the image forming apparatus shown in FIG. 1.

FIG. 3 shows the control circuit of the multifunction electrophotographic copying machine. As is apparent from FIG. 3, a main CPU 50 is connected to a control program storage ROM 51, data storage RAM 52, pixel counter 53, image processor 55, page memory controller 56, hard disk unit 58, network interface 59, FAX transmission/reception unit 60, and the like. The main CPU 50 is connected to a scan CPU 70, control panel CPU 80, print CPU 90, and the like.

The main CPU 50 comprehensively controls the scan CPU 70, control panel CPU 80, and print CPU 90. The main CPU 50 functions as a copy mode control means corresponding to copy key operation, a printer mode control means corresponding to image input to the network interface 59, and a facsimile mode control means corresponding to image reception by the FAX transmission/reception unit 60.

The page memory controller 56 controls write/read of image data in/from a page memory 57. The image processor 55, page memory controller 56, page memory 57, hard disk unit 58, network interface 59, and FAX transmission/reception unit 60 are connected to each other via an image data bus 61.

The scan CPU 70 is connected to a control program storage ROM 71, a data storage RAM 72, a signal processor 73 which processes an output from the CCD 10 and supplies the processed data to the image data bus 61, a CCD driver 74, a scan motor driver 75, the exposure lamp 5, the automatic document feeder 40, a plurality of document sensors 11, and the like.

The control panel CPU 80 is connected to a touch panel type liquid crystal display 14, ten-key pad 15, all-reset key 16, copy key 17, and stop key 18 on the control panel.

The print CPU 90 is connected to a control program storage ROM 91, a data storage RAM 92, a print engine 93, a paper convey unit 94, a process unit 95, and the fixing device 100. The print engine 93 is comprised of the laser unit 27, its driving circuit, and the like. The paper convey unit 94 is constituted by a paper convey mechanism from a paper feed cassette 30 to a tray 38, a driving circuit for this mechanism, and the like. The process unit 95 is formed by the photo-sensitive drum 20, its peripheral unit, and the like.

Figure 4:
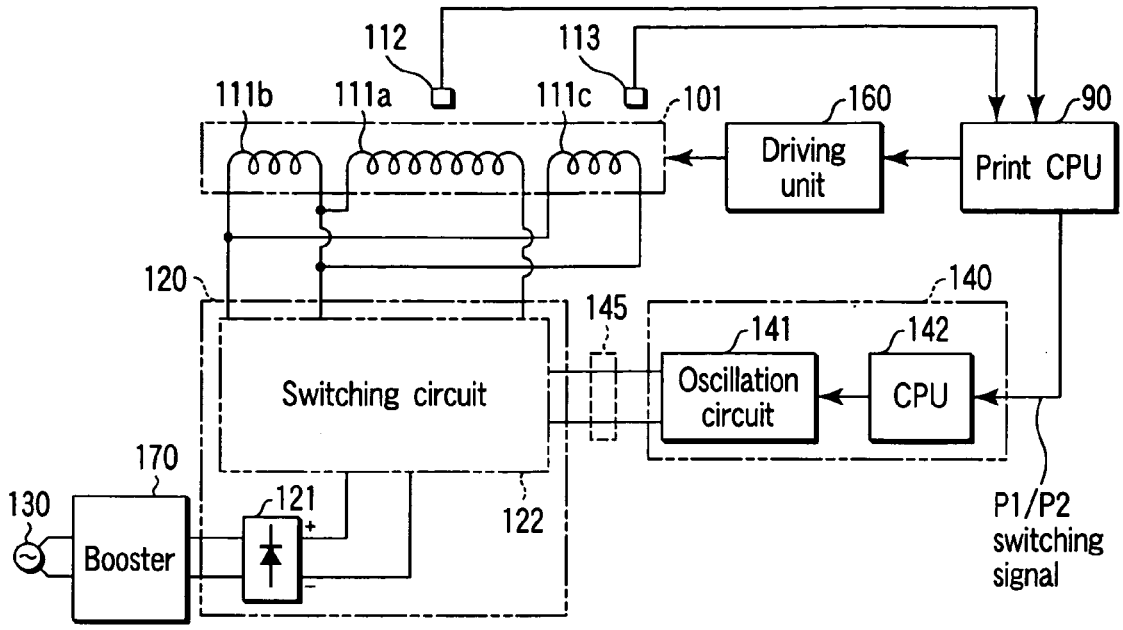
FIG. 4 is a block diagram for explaining an example of the control system of the fixing device to which the embodiment of the present invention can be applied.

FIG. 4 shows an example of the arrangement of the electrical circuit of the fixing device 100.

The induction heating portion 110 stored in the heating roller 101 has the coil 111 including a plurality of coils (111*a*, 111*b*, and 111*c*). In the example shown in FIG. 4, the coil 111 is divided into the three coils 111*a*, 111*b*, and 111*c*. In the example shown in FIG. 4, the coil 111*a* forms the first coil, and exists at the center of the heating roller 101. The coils 111*b* and 111*c* form the second coil, and are located at positions where they sandwich the coil 111*a* in the heating roller 101. The coils 111*a*, 111*b*, and 111*c* are connected to a high-frequency generation circuit 120.

A temperature sensor 112 is arranged at the center of the heating roller 101. The temperature sensor 112 detects a temperature at the center of the heating roller 101. A temperature sensor 113 is arranged at one end of the heating roller 101. The temperature sensor 113 detects a temperature at one end of the heating roller 101. The temperature sensors 112 and 113 are connected to the print CPU 90 together with a driving unit 160 for rotating and driving the heating roller 101.

The print CPU 90 comprises a function of controlling the driving unit 160, in addition to a function of generating a P1/P2 switching signal for designating the operation of the first resonant circuit (output power P1: to be described later) constituted by the coil 111*a* serving as the first coil and the operation of the second resonant circuit (output power P2: to be described later) constituted by the coils 111*b* and 111*c* serving as the second coil, and a function of performing control in accordance with the output power of each resonant circuit and the detection temperatures of the temperature sensors 112 and 113.

The high-frequency generation circuit 120 generates high-frequency power for generating a high-frequency magnetic field. The high-frequency generation circuit 120 comprises a rectifying circuit 121, and a switching circuit 122 connected to the output terminal of the rectifying circuit 121.

The rectifying circuit 121 rectifies an AC voltage applied from a commercial AC power supply 130 via a booster 170.

In the present invention, the booster 170 is arranged such that the voltage from the commercial AC power supply 130 serving as a power supply means copes with 100 V to 240 V. The booster 170 so operates as to always keep the output-side voltage at 240 V for an input-side voltage of 100 V to 240 V.

More specifically, the input voltage of the high-frequency generation circuit 120 is adjusted (boosted) by the booster 170 in the above-described manner without adjusting the coil characteristic to the voltage specification (commercial AC power supply) and individually designing the coil. The coil 111 can operate in the same way regardless of the voltage specification (commercial AC power supply). The switching circuit 122 forms the first resonant circuit by the coil 111*a*, and the second resonant circuit by the coils 111*b* and 111*c*.

The first and second resonant circuits are selectively excited by a switching element (e.g., a transistor such as an FET: not shown) arranged in the switching circuit 122.

The coils 111*b* and 111*c* which constitute the second coil are parallel-connected to the switching circuit 122. When the first or second coil is formed by a plurality of coils at the induction heating portion 110, the coils are similarly parallel-connected to the switching circuit 122.

The first resonant circuit has a resonance frequency f1 which is determined by the inductance of the coil 111*a*, the electrostatic capacitance of a capacitor (not shown) within the switching circuit 122, and the like. The second resonant circuit has a resonance frequency f2 which is determined by the inductances of the coils 111*b* and 111*c*, the electro-static capacitance of the capacitor (not shown) within the switching circuit 122, and the like.

The switching circuit 122 is ON/OFF-driven by a controller 140 in accordance with the P1/P2 switching signal from the print CPU 90. The controller 140 comprises an oscillation circuit 141 and CPU 142. The oscillation circuit 141 generates a driving signal having a predetermined frequency to the switching circuit 122. The CPU 142 controls the oscillation frequency of the oscillation circuit 141 (frequency of the driving signal). The CPU 142 has, e.g., the following means (1) and (2) as main functions.

(1) The CPU 142 has a control means for sequentially (alternately) exciting the first resonant circuit at a plurality of frequencies, e.g., (f1−Δf) and (f1+Δf) around the resonance frequency f1 when the operation of the first resonant circuit (using only the coil 111*a*) is designated by the P1/P2 switching signal from the print CPU 90.

(2) The CPU 142 has a control means for sequentially exciting the first and second resonant circuits at a plurality of frequencies, e.g., (f1−Δf), (f1+Δf), (f2−Δf), and (f2+Δf) around the resonance frequencies f1 and f2 when the operations of the first and second resonant circuits (using all the coils 111*a*, 111*b*, and 111*c*) are designated by the P1/P2 switching signal from the print CPU 90.

The operation of the electrical circuit of the fixing device 100 having the above arrangement will be explained.

When the oscillation circuit 141 generates a driving signal having the same frequency as (or a frequency close to) the resonance frequency f1 of the first resonant circuit, the switching circuit 122 is turned on/off by the driving signal to excite the first resonant circuit. Upon excitation, the coil 111*a* generates a high-frequency magnetic field. The high-frequency magnetic field generates an eddy current at the center of the heating roller 101 along the axis, and Joule heat by the eddy current causes self-heating at the center of the heating roller 101 along the axis.

When the oscillation circuit 141 generates a driving signal having the same frequency as (or a frequency close to) the resonance frequency f2 of the second resonant circuit, the switching circuit 122 is turned on/off by the driving signal to excite the second resonant circuit. Upon excitation, the coils 111*b* and 111*c* generate a high-frequency magnetic field. The high-frequency magnetic field generates an eddy current at the two sides of the heating roller 101 along the axis, and Joule heat by the eddy current causes self-heating at the two sides of the heating roller 101 along the axis.

Figure 5:
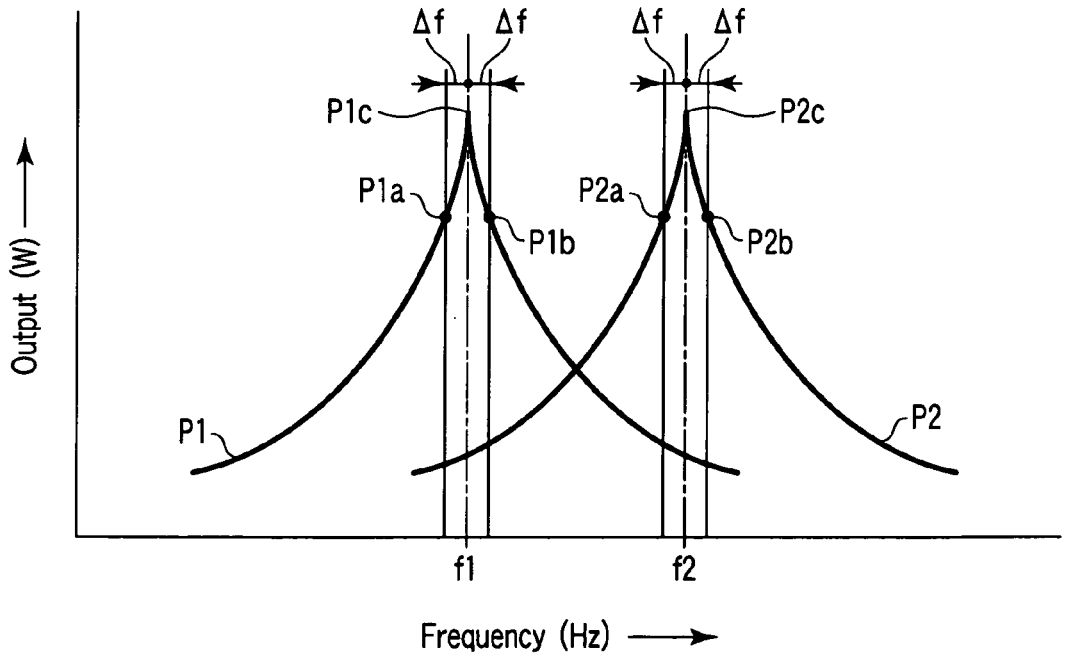
FIG. 5 is a graph showing the relationship between the output power of a resonant circuit shown in FIG. 4 and the frequency which excites the resonant circuit.

The present invention is not limited to the arrangement shown in FIG. 4, and may adopt an arrangement to be described later with reference to FIG. 9. FIG. 5 is a graph showing the relationship between the output power P1 of the first resonant circuit and the frequency for exciting the first resonant circuit, and the relationship between the output power P2 of the second resonant circuit and the frequency for exciting the second resonant circuit.

As shown in FIG. 5, the output power P1 of the first resonant circuit exhibits a pattern in which the output power P1 reaches the peak level when the first resonant circuit is excited at the same frequency as the resonance frequency f1 of the first resonant circuit, and gradually decreases as the excitation frequency moves apart from the resonance frequency f1.

Similarly, the output power P2 of the second resonant circuit exhibits a pattern in which the output power P2 reaches a peak level when the second resonant circuit is excited at the same frequency as the resonance frequency f2 of the second resonant circuit, and gradually decreases as the excitation frequency moves apart from the resonance frequency f2.

In fixing on a large-size paper sheet S, both the first and second resonant circuits are excited, and all the coils 111*a*, 111*b*, and 111*c* generate a high-frequency magnetic field. The high-frequency magnetic field generates an eddy current in the entire heating roller 101, and Joule heat by the eddy current causes self-heating in the entire heating roller 101. In this case, the oscillation circuit 141 sequentially outputs driving signals having two frequencies (f1−Δf) and (f1+Δf) which are vertically separated by a predetermined value Δf in opposite directions from the resonance frequency f1 of the first resonant circuit. After that, the oscillation circuit 141 sequentially outputs driving signals having two frequencies (f2−Δf) and (f2+Δf) which are vertically separated by the predetermined value Δf in opposite directions from the resonance frequency f2 of the second resonant circuit.

With these driving signals, the first resonant circuit is sequentially excited at the two frequencies (f1−Δf) and (f1+Δf) which sandwich the resonance frequency f1. The second resonant circuit is sequentially excited at the two frequencies (f2−Δf) and (f2+Δf) which sandwich the resonance frequency f2. Excitation is repeated at these frequencies.

As shown in FIG. 5, the output power P1 of the coil 111*a* in the first resonant circuit exhibits a value P1*a* slightly smaller than a peak level P1*c* upon excitation at the frequency (f1−Δf), and a value P1*b* slightly smaller than the peak level P1*c* upon excitation at the frequency (f1+Δf).

The output power P2 of the coils 111*b* and 111*c* in the second resonant circuit exhibits a value P2*a* slightly smaller than a peak level P2*c* upon excitation at the frequency (f2−Δf), and a value P2*b* slightly smaller than the peak level P1*c* upon excitation at the frequency (f2+Δf):

FIRST EMBODIMENT

Figure 6:
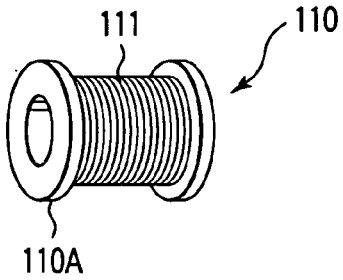
FIG. 6 is a perspective view showing an example of a coil unit.

FIG. 6 shows the arrangement of a coil unit 110. The coil unit 110 is formed by a coil bobbin 110A whose outer surface is wound with a wire serving as a coil 111.

Figure 7:
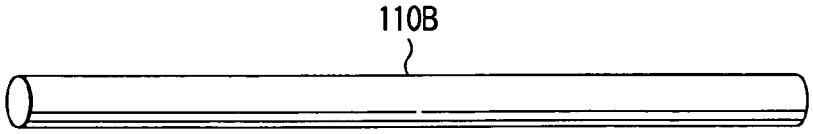
FIG. 7 is a perspective view showing an example of a holding member.

FIG. 7 shows the basic arrangement of a holding member 110B which holds the coil bobbin 110A.

Figure 8:
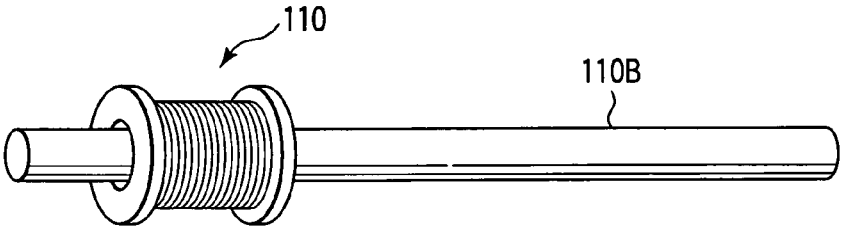
FIG. 8 is a perspective view showing a state in which the coil unit shown in FIG. 6 is held by the holding member shown in FIG. 7.

FIG. 8 shows a state in which the holding member 110B holds the coil unit 110. The holding member 110B is comprised of a plurality of coil units 110 (e.g., six or 12 coil units 110).

Figure 9:
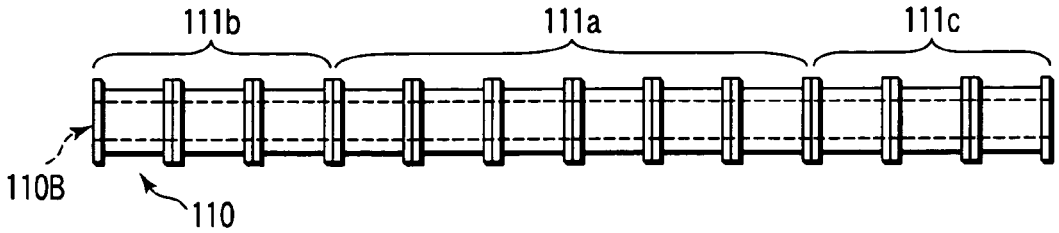
FIG. 9 is a plan view showing an example of an induction heating portion.

FIG. 9 shows an arrangement example using 12 induction heating coil units 110 which are stored in a heating roller 101 according to the first embodiment. In the arrangement example of FIG. 9, three left coil units 110 in FIG. 9 form a coil 111*b* shown in FIG. 4 on the holding member 110B. Subsequent six coil units 110 form a coil 111*a* shown in FIG. 4, and subsequent three coil units 110 form a coil 111*c* shown in FIG. 4.

As described above, the coil units 110 can be coupled to constitute a plurality of coils (111*a*, 111*b*, and 111*c*). The coils of the coil units 110 are series- or parallel-connected to constitute the above-mentioned coils 111*a*, 111*b*, and 111*c*.

The coil unit 110 according to the present invention uses as a coil a wire which is formed by copper insulated by polyimide resin and has a wire diameter of about 0.1 mm to 1.0 mm. In the first embodiment, the wire diameter is about 0.5 mm . The coil unit 110 is driven at a high frequency of 2 MHz.

As described above, according to the first embodiment, the voltage from a commercial AC power supply is adjusted (boosted) by a booster 170 for the input voltage of a high-frequency generation circuit 120. The coil 111 can operate in the same way regardless of the commercial AC power supply.

According to the first embodiment, the induction heating coil stored in the heating roller 101 is comprised of a plurality of coil units. This can simplify the arrangement and facilitate the assembly.

As described above, in the first embodiment usable the coil units having different coil bobbin widths (dimension).

SECOND EMBODIMENT

An example of part of an induction heating portion applicable to a fixing device according to the present invention will be explained.

Figure 10:
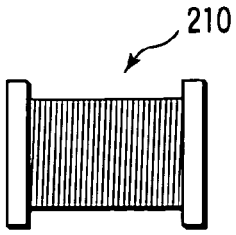
FIG. 10 is a plan view showing another example of the coil unit.
Figure 11:
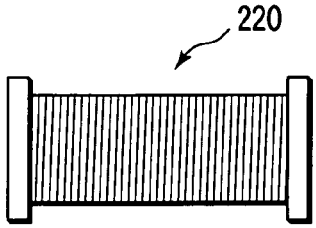
FIG. 11 is a plan view showing the skin effect as a phenomenon in induction heating.

FIGS. 10 and 11 show coil units having different coil bobbin widths. That is, a coil bobbin width used for a coil unit 210 shown in FIG. 10 is smaller than that used for a coil unit 220 shown in FIG. 11.

The number of turns of the wire of the coil unit 210 and that of the coil unit 220 are different.

In the first embodiment shown in FIG. 9, the coil is constituted using identical coil units 110. In the second embodiment, the coil is constituted using the different coil units 210 and 220.

In the second embodiment, the overall length of an induction heating coil in changing the heating width can be easily set by combining the coil units 210 and 220.

In the second embodiment, coils having two different numbers of turns can be easily combined by the coil units 210 and 220.

The temperature distribution can be made axially symmetrical by combining coils having two different numbers of turns using the coil units 210 and 220.

The second embodiment uses the two types of coil units. Alternatively, two or more different coil bobbin widths or two or more different numbers of turns may be adopted. By combining different coil bobbin widths or different numbers of turns, a finer setting can be achieved.

As described above, according to the second embodiment, assembly cumbersomeness can be eliminated, and an induction heating coil with heating widths of various characteristics can be constituted by combining two or more types of coil units with different coil bobbin widths.

By combining two or more types of coil units with different numbers of turns, assembly cumbersomeness can be eliminated, and an induction heating coil with heating widths of various characteristics can be constituted.

By combining two or more types of coil units with different numbers of turns, induction heating coils can be arranged axially symmetrical to make the temperature distribution symmetrical.

THIRD EMBODIMENT

Another example of the induction heating portion applicable to a fixing device according to the present invention will be explained.

In an induction heating coil obtained by parallel-connecting a plurality of coils, the connection of coils becomes complicated by parallel-arranging coils wound around the same shaft as that of a heating roller 101.

From this, the third embodiment also constitutes the induction heating coil using a plurality of coil units as shown in FIG. 9.

Figure 12:
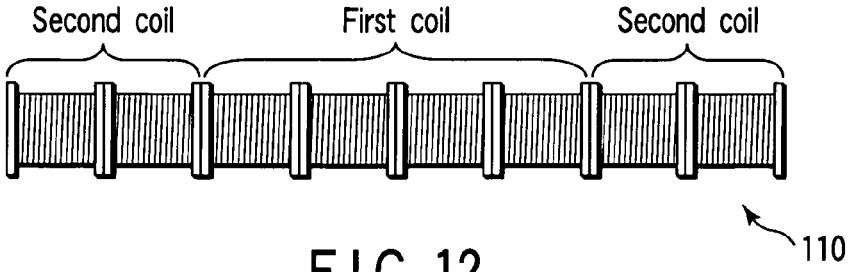
FIG. 12 is a plan view showing the section of a coil wire generally used in induction heating.

FIG. 12 shows an arrangement example using eight induction heating coil units 110 shown in FIG. 6 which are stored in the heating roller 101 according to the third embodiment. The induction heating coil according to the third embodiment is formed by the first coil which is positioned at almost the center of a paper sheet conveyed to the heating roller 101 and the second coil which is positioned at the two sides of the first coil when the induction heating coil is stored in the heating roller 101.

In the example of FIG. 12, the first coil is formed by four coil units 110, and the second coil is formed by two left coil units 110 in FIG. 12 and two right coil units 110 in FIG. 12.

In the third embodiment, the number of coil units of the first coil is four, and that of the second coil is also four. With this setting, the excitation circuits of a high-frequency generation circuit 120 which drive these coils can be formed by identical circuits, and the circuit can be simplified at low cost.

As shown in FIG. 4, the first coil corresponds to a coil 111*a*, and the roller temperature is detected by a temperature sensor 112. The second coil corresponds to coils 111*b* and 111*c*, the roller temperature is detected by a temperature sensor 113, and the temperature is controlled constant.

In energization control in the induction heating coil divided in the above manner, a lower one of temperatures detected by the temperature sensors 112 and 113 corresponding to the first and second coils is controlled to a predetermined fixing temperature.

Energization distribution is as follows.

When an output from the temperature sensor 112 is lower, the output ratio of the first coil to the second coil is 80:20 to 90:10.

When an output from the temperature sensor 113 is lower, the output ratio of the first coil to the second coil is 40:60 to 30:70.

As described above, according to the third embodiment, the number of coil units which form the first coil and that of coil units which form the second coil are designed equal to each other. Excitation circuits which drive these coils can take the same circuit arrangement, and the circuit can be simplified at low cost.

FOURTH EMBODIMENT

Figure 13:
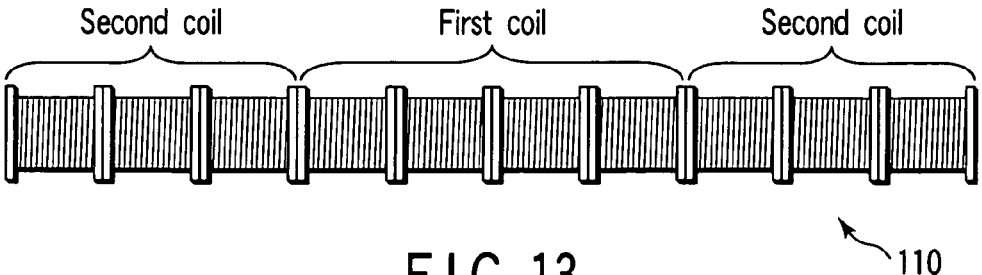
FIG. 13 is a plan view showing the section of a coil wire applicable to the induction heating portion of the present invention.

FIG. 13 shows an arrangement example using 10 induction heating coil units 110 shown in FIG. 6 which are stored in a heating roller 101 according to the fourth embodiment. The induction heating coil according to the fourth embodiment is formed by the first coil which is positioned at almost the center of a conveyed paper sheet and the second coil which is positioned at the two sides of the first coil when the induction heating coil is stored in the heating roller 101.

In the example of FIG. 13, the first coil is formed by four coil units 110, and the second coil is formed by three left coil units 110 in FIG. 13 and three right coil units 110 in FIG. 13.

In the fourth embodiment, the number of coil units of the first coil is four, and that of the second coil is six.

In the induction heating coil in which a plurality of coils (coil units) are parallel-connected as described in the third embodiment, the first and second coils are simultaneously energized. Thus, the potential differences between adjacent wires must be equal on the common potential side.

That is, when the number of coil units of the first coil is odd, either side fails to obtain the common potential. Hence, the first coil must be comprised of an even number of coil units. The number of coil units of the second coil can be even or odd, and the entire induction heating coil is formed by an even number of coil units.

As described above, according to the fourth embodiment, when the induction heating coil is constituted by parallel-connecting a plurality of coils (coil units), the number of coil units is set to an even number. The potential differences between adjacent wires in the first and second coils become equal, ensuring the common potential.

FIFTH EMBODIMENT

An example of a coil unit applicable to a fixing device according to the present invention will be explained.

Figure 14:
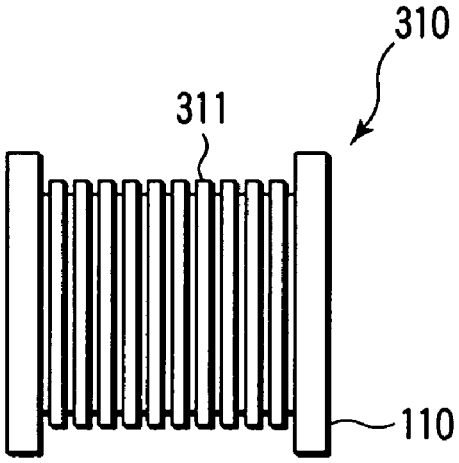
FIG. 14 is a plan view showing still another example of the coil unit.

FIG. 14 shows the arrangement of a coil unit 310. As shown in FIG. 14, the coil unit 310 has a coil 311 wound around a coil bobbin 110A described with reference to FIG. 6. The coil 311 is, e.g., a 0.5-mm single wire, and the wire material is copper.

Figure 15:
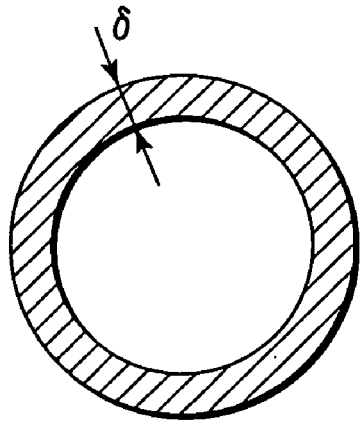
FIG. 15 is a sectional view showing still another example of the coil unit.

FIG. 15 shows the skin effect as a phenomenon in induction heating. In induction heating, the current flows through only the coil surface.

The skin depth of the current substantially complies with $\delta=5.03\sqrt{(\rho/\mu f)}$.

where ρ: conductor resistivity [$\Omega^{-cm}$]

μ: conductor relative permeability f: frequency [Hz]

In other words, the skin depth δ of the current changes with frequency f.

In a bent coil, the current readily flows inside, which is called a heating coil effect.

Induction heating is based on the two typical phenomena: skin effect and heating coil effect.

When the high-frequency current is further supplied, the coil impedance increases. A large impedance can reduce the current with the same output.

If the current is small, the wire diameter can also be decreased. For example, the wire diameter is about 3 mm for a 20-kHz coil, and about 1 mm to 0.5 mm for a 2-MHz coil.

Hence, the impedance can be increased by increasing the frequency, and the current value (effective value) can be decreased to 5 A or less.

The wire diameter can be further decreased, but the number of turns of the coil is defined by the impedance matching property.

The coil can be formed by a single wire within the following range for $\sqrt{A/L} \geqq 1$.

A: frequency

L: overall coil length (total length of coils 111*a*, 111*b*, and 111*c* in FIG. 4)

Because of the heating coil effect, a solenoid generally incorporates a work serving as an object to be heated. A high-frequency coil hardly exhibits the heating coil effect due to a thin wire, and even when an object to be heated (work: heating roller) is set outside, the object can be sufficiently heated.

FIG. 15 shows the section of a stranded wire generally used in induction heating. For example, a general coil has a frequency of 20 kHz (man cannot hear it), a current skin depth δ of 0.2 to 0.3 mm, 19 or more 0.5-mm stranded wires, a current of 60 A, a voltage of 650 V, and an effective value of 12 to 13 A.

Figure 16:
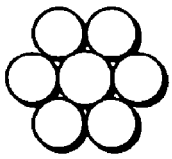
FIG. 16 is a sectional view showing another example of the induction heating portion.
Figure 17:
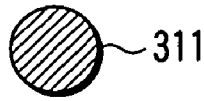
FIG. 17 is a sectional view showing still another example of the induction heating portion.

FIG. 16 shows the section of a single wire used in the present invention. The present invention sets the wire diameter to about 1 mm to 0.5 mm. The wire material is copper. Instead of a generally used frequency of 20 kHz, the present invention uses a high frequency of, e.g., 2 MHz. The impedance is high, the current is small, and the effective value is about 1 A. The use of a single wire provides the following merits.

(1) The cost can be suppressed low. In other words, the stranded wire step for the wire can be omitted, and the wire can be shortened.

(2) The proximity effect of the wire is obtained.

(3) The packaging density can be increased.

(4) The finishing accuracy can be increased.

As described above, the fifth embodiment uses a single wire for the coil. The proximity effect is generated between proximate wires, and the impedance at a portion where wires come close to each other changes to obstruct the current flow. As a result, a compact, high-performance coil can be implemented.

SIXTH EMBODIMENT

An example of the coil unit applicable to the sixth embodiment will be described with reference to FIGS. 18 to 21.

Figure 18:
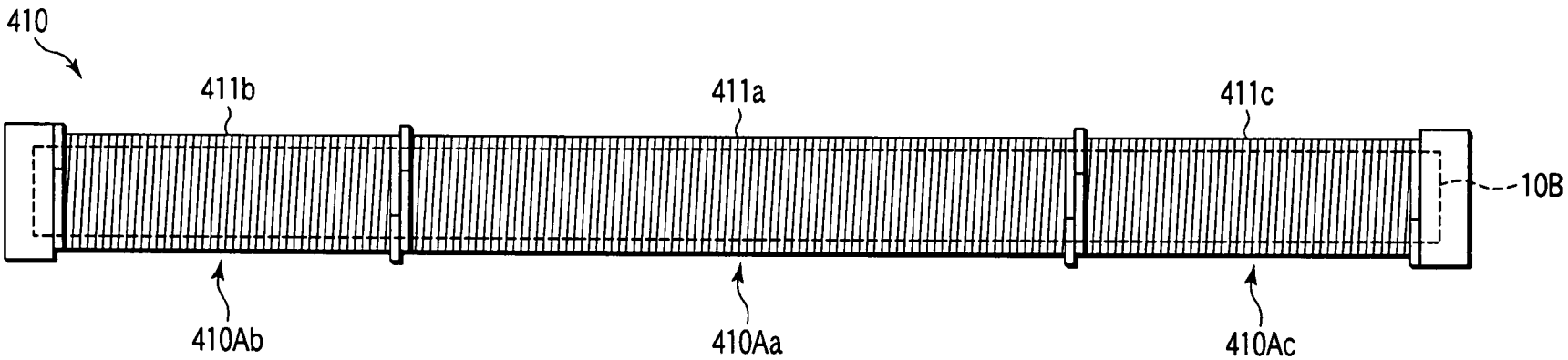
FIG. 18 is a plan view showing still another example of the induction heating portion.

As shown in FIG. 18, the coil unit 410 has the coils 411*a*, 411*b*, and 411*c* obtained by winding coil bobbins 410Aa, 410Ab, and 410Ac with a wire having a predetermined sectional area. The coil bobbin 410Aa is formed longer in the longitudinal direction than the coil bobbins 410Ab and 410Ac at two ends. That is, the number of turns of the coil 411*a* is larger than that of the coil 411*b* or 411*c*, and is twice in this example.

Figure 19:
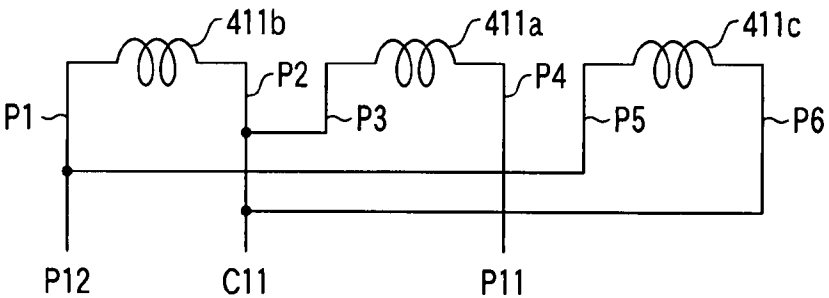
FIG. 19 is a circuit diagram for explaining the electrical connection of the induction heating portion shown in FIG. 18.

As shown in FIG. 19, an end P2 of the coil 411*a*, an end P3 of the coil 411*b*, and an end P6 of the coil 411*c* are connected to a connection portion C11. The end of the coil 411*a* is connected to a terminal P11. An end P1 of the coil 411*b* and an end P5 of the coil 411*c* are connected to a connection portion P12. The connection portion C11 receives power of the same level (i.e., the product of the voltage and power) as the low-voltage (common) side of the output powers P1 and P2. The connection portions P11 and P12 receive powers on the high-voltage sides of the output powers P1 and P2.

Figure 20:
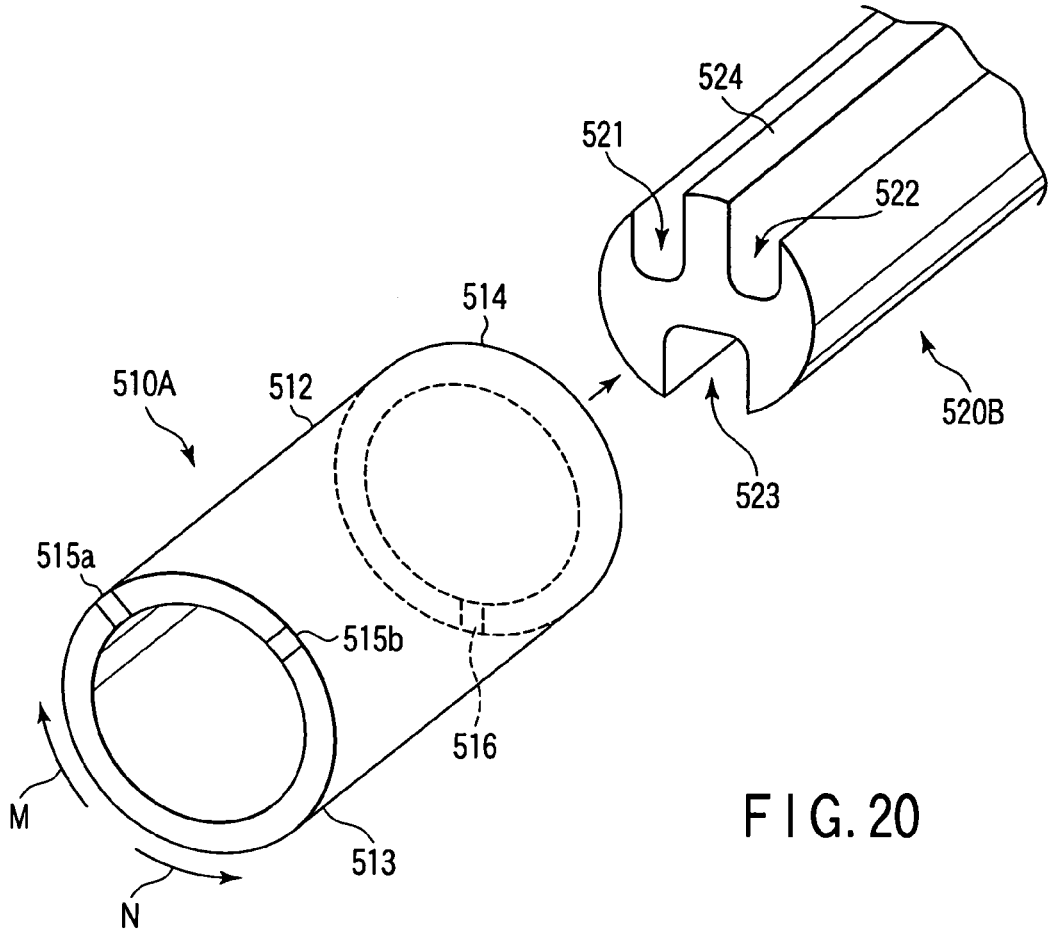
FIG. 20 is a perspective view showing an example of the relationship between the coil bobbin and the holding member.

The coils 411*a*, 411*b*, and 411*c* may be integrally assembled by a coil bobbin 510A as shown in FIG. 20. The coil bobbins 410Aa to 410Ac are formed similar to the coil bobbin 510A.

As shown in FIG. 20, the coil bobbin 510A has a cylindrical shape with a predetermined hollow. The coil bobbin 510A comprises a surface 512 wound with a wire on the outer surface, and edges 513 and 514 formed at the two ends of the surface 512. The edge 513 has wiring notches 515*a* and 515*b* used to lay out a wire between the surface 512 and the hollow. The edge 514 has a notch 516. The edges 513 and 514 of the coil bobbin 510A may have flanges which prevent removal of a wire wound around the surface from the bobbin.

Figure 21:
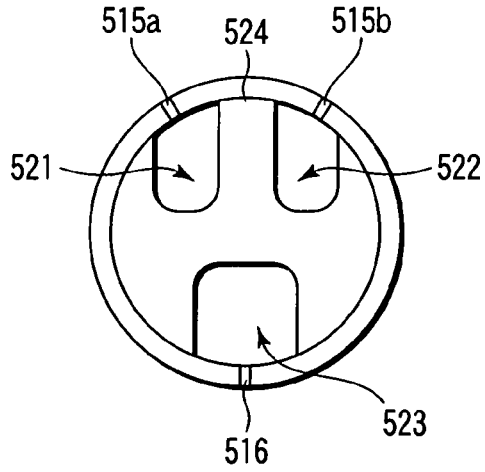
FIG. 21 is a schematic sectional view showing a state in which the coil bobbin shown in FIG. 20 is held by the holding member.

The coil bobbin 510A is held by a holding member 520B which can be inserted into the hollow. As shown in FIG. 21, the holding member 520B has grooves 521, 522, and 523 which are formed to be able to store wires passing through the notches 515*a*, 515*b*, and 516, i.e., leads (connected to connection portions) extending from the ends P1 to P6 of the coils 411*a*, 411*b*, and 411*c*. The grooves 521, 522, and 523 have predetermined sectional areas, and can maintain predetermined spaces between the coil bobbin 510A and the holding member 520B while incorporating wires. The groove 523 has a sectional area larger than those of the grooves 521 and 522, and the grooves 521 and 522 have almost the same sectional area.

In the coil unit 410 shown in FIG. 18, the connection portions C11, P11, and P12 can be extracted from the grooves 523, 521, and 522 of the holding member 520B.

This will be explained in more detail. An end P4 (high-voltage side in this case) of the coil 411*a* is guided to the hollow by the notch 515*a*, passes through the groove 521, and is connected to the connection portion P11. The end P1 of the coil 411*b* and the end P5 of the coil 411*c* (high-voltage sides in this case) are guided to the hollow by the notch 516, pass through the groove 523, and are connected to the connection portion C11.

Another example applicable to the coil unit of the present invention will be described with reference to FIGS. 20 to 24.

Figure 22:
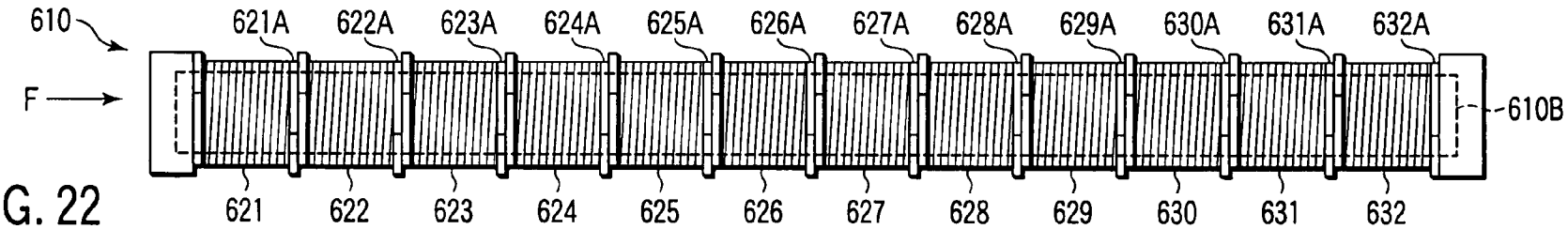
FIG. 22 is a plan view showing still another example of the induction heating portion.

As shown in FIG. 22, a coil unit 610 has a plurality of coils arranged in the longitudinal direction. For example, the coil unit 610 has 12 coils 621 to 632 obtained by winding coil bobbins 621A to 632A with a predetermined wire. The coils 621 to 632 which are held by a holding member 610B in a predetermined array are classified into predetermined coil groups and connected in accordance with specifications required for a copying machine 1 and the magnitude of power which can be input.

Figure 23:
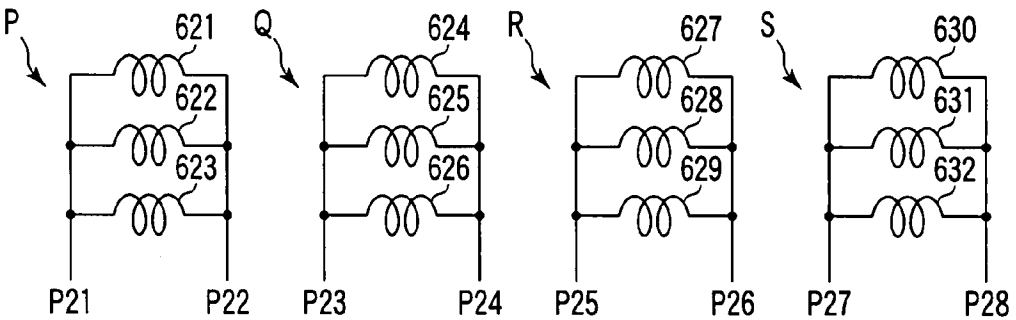
FIG. 23 is a circuit diagram for explaining the electrical connection of the induction heating portion shown in FIG. 22.

As shown in FIG. 23, the coils 621 to 632 are classified into four coil groups P (coils 621 to 623), Q (coils 624 to 626), R (coils 627 to 629), and S (coils 630 to 632) in each of which three coils are parallel-connected. The coil group P has ends P21 and P22, the coil group Q has ends P23 and P24, the coil group R has ends P25 and P26, and the coil group S has ends P27 and P28.

Figure 24:
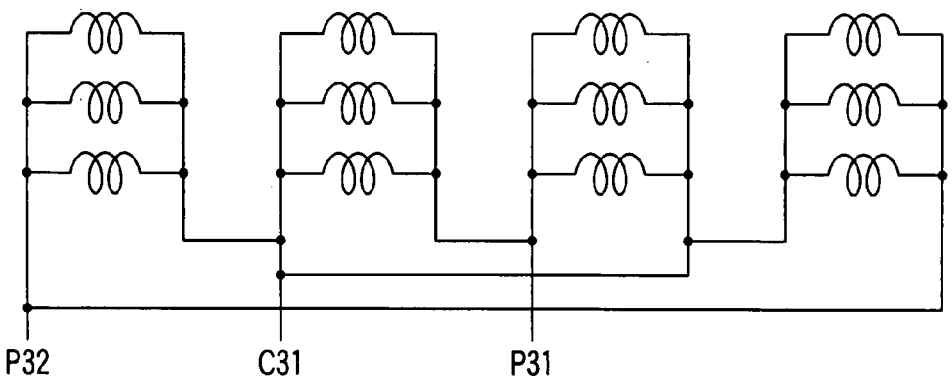
FIG. 24 is a circuit diagram for explaining the electrical connection of the induction heating portion shown in FIG. 22.

As shown in FIG. 24, the coil groups Q and R are connected as the first coil group, whereas the coil groups P and S are connected as the second coil group. The first and second coil groups receive powers of the same magnitude or different magnitudes. Of powers supplied to the first and second coil groups, the values of low-voltage sides (called common sides) are the same. For this reason, a connection portion C31 is connected to the ends P22, P23, P26, and P27 of the coil groups P, Q, R, and S. As described with reference to FIG. 22, the ends P22 and P23 are so connected as to receive powers of the same level in consideration of the influence of magnetic fields generated by the adjacent coils 623 and 624. Similarly, the ends P26 and P27 are so connected as to receive powers of the same level in consideration of the influence of magnetic fields generated by the adjacent coils 629 and 630.

The ends P24 and P25 of the coil groups Q and R serving as the first coil group are connected to a connection portion P31. The connection portion P31 receives high-voltage power out of powers supplied to the first coil group. Similarly, the ends P21 and P28 of the coil groups P and S serving as the second coil group are connected to a connection portion P32. The connection portion P32 receives high-voltage power out of powers supplied to the second coil group. As described with reference to FIG. 22, the ends P24 and P25 are so connected as to receive powers of the same level in consideration of the influence of magnetic fields generated by the adjacent coils 626 and 627.

The coils 621 to 632 are integrally assembled by a coil bobbin 510A as described with reference to FIGS. 20 and 21.

In the coil unit 610 utilizing the coil bobbin 510A and holding member 520B, the connection portions C31, P31, and P32 can be extracted from grooves 523, 521, and 522 of the holding member 520B.

This will be explained in more detail. One-side ends (high-voltage side in this case) of the coils 624, 625, and 626 serving as the end P24 shown in FIG. 23 in the coil group Q are guided to the hollow by the notch 515*a*, pass through the groove 521, and are connected to the connection portion P31. One-side ends (high-voltage side in this case) of the coils 627, 628, and 629 serving as the end P25 of the coil group R are guided to the hollow by the notch 515*a*, pass through the groove 521, and are connected to the connection portion P31.

One-side ends (high-voltage side in this case) of the coils 621, 622, and 623 serving as the end P21 of the coil group P are guided to the hollow by the notch 515*b*, pass through the groove 522, and are connected to the connection portion P32. One-side ends (high-voltage side in this case) of the coils 630, 631, and 632 serving as the end P28 of the coil group S are guided to the hollow by the notch 515*b*, pass through the groove 522, and are connected to the connection portion P32.

To the contrary, the other-side ends of the coils 621 to 632 (i.e., the low-voltage (common) sides of the coils) are guided to the hollow by the notch 516, pass through the groove 523, and are connected to the connection portion C31.

In the coil unit 610, wires which receive powers of the same level are stored in the same groove. This allows supplying high-frequency power without considering the influence of a magnetic field or the like.

The use of the holding member 520B shown in FIGS. 20 and 21 simplifies the arrangement of the coil unit 610 having a plurality of coils, and facilitates wiring operation (work).

As described above, wires which receive the low-voltage (common) powers of the first and second coil groups are laid out together (at once) in the groove 523, downsizing and simplifying The coil unit 610.

In the holding member 520B, letting A be the number of coil groups which sequentially or simultaneously generate heat by sequentially or simultaneously supplying predetermined power to respective coils, the number of grooves serving as wire paths which store the wires of the coils is A+1 or more. In the coil unit 610 connected as the first and second coil groups, the number A of coil groups is A=2, and A+1 is established in the holding member 520B including the three grooves 661 to 663.

Still another example of a coil unit which is applied to a fixing device according to the present invention will be described with reference to FIGS. 22 to 26.

Of the four coil groups P, Q, R, and S shown in FIG. 23, the coil groups P and Q are connected as the first coil group, and the coil group R is connected as the second coil group. Hence, the coil group S serves as the third coil group. The first, second, and third coil groups receive powers having different high-voltage levels and the same low-voltage (common) level. The ends P22, P23, P26, and P27 of the coil groups P, Q, R, and S receive low-voltage powers of the same level. The ends P21 and P24 of the coil groups P and Q receive high-voltage power of the first coil group. The end P25 of the coil group R receives high-voltage power of the second coil group, and the end P28 of the coil group S receives high-voltage power of the third coil group. The high-voltage levels of powers supplied to the first and second coil groups may be substantially the same.

Figure 25:
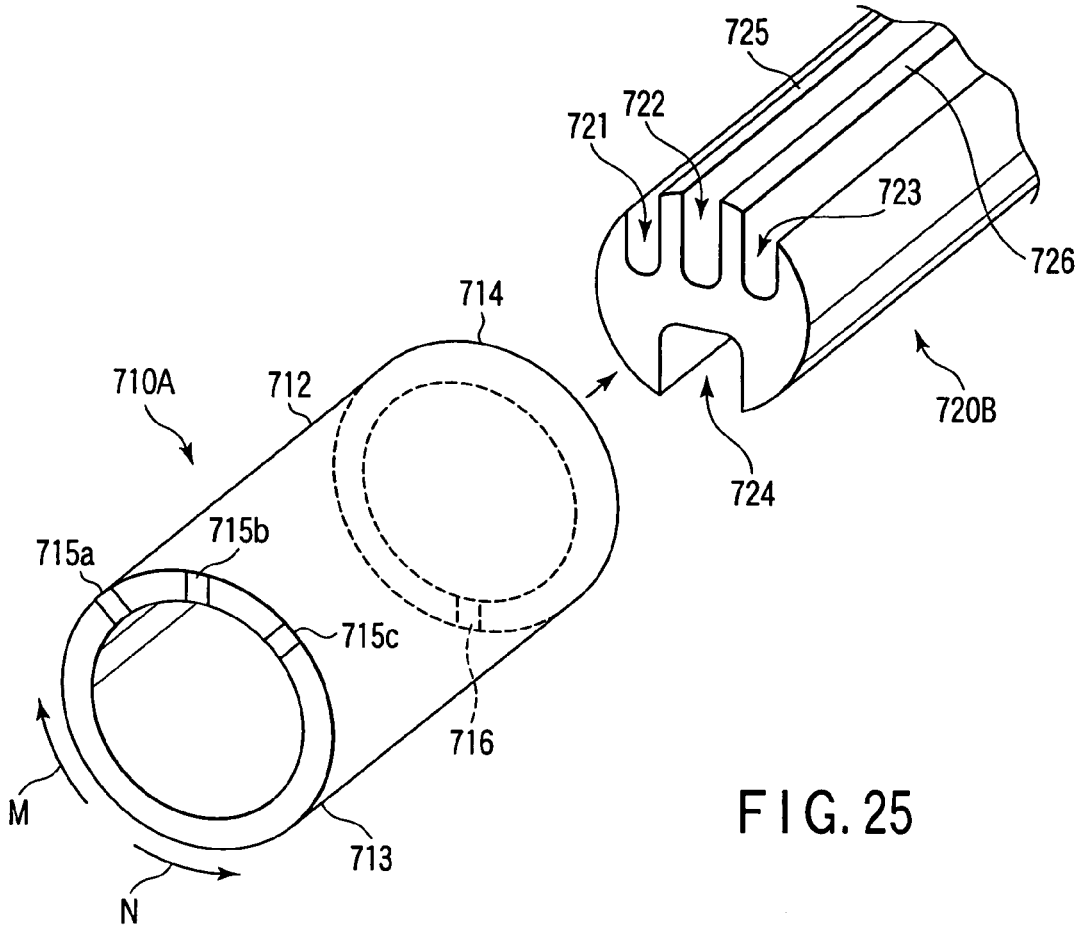
FIG. 25 is a perspective view showing another example of the relationship between the coil bobbin and the holding member.
Figure 26:
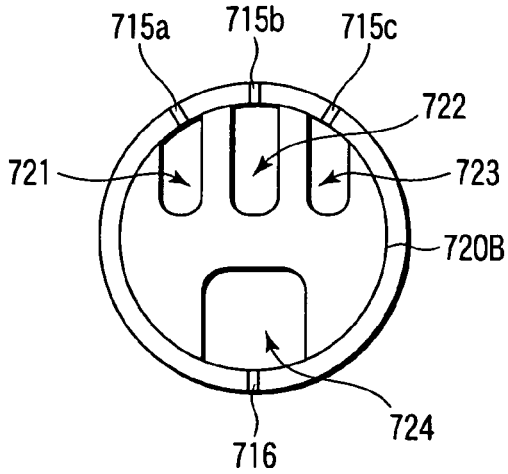
FIG. 26 is a schematic sectional view showing a state in which the coil bobbin shown in FIG. 25 is held by the holding member.

The coils 621 to 632 are integrally assembled by a coil bobbin 710A as shown in FIGS. 25 and 26.

As shown in FIG. 25, the coil bobbin 710A has a cylindrical shape with a predetermined hollow. The coil bobbin 710A comprises a surface 712 wound with a wire on the outer surface, and edges 713 and 714 formed at the two ends of the surface 712. The edge 713 has notches 715*a*, 715*b*, and 715*c*. The edge 714 has a notch 716. The edges 713 and 714 of the coil bobbin 710A may have flanges which prevent removal of a wire wound around the surface from the bobbin.

The coil bobbin 710A is held by a holding member 720B which can be inserted into the hollow. As shown in FIG. 26, the holding member 720B has grooves 721, 722, 723, and 724 which are formed to be able to store wires passing through the notches 715*a*, 715*b*, 715*c*, and 716, i.e., leads extending from the ends P21 to P28 of coils 621 to 632. The grooves 721, 722, 723, and 724 have predetermined sectional areas, and can maintain predetermined spaces between the coil bobbin 710A and the holding member 720B while incorporating wires. The groove 724 has a sectional area larger than those of the grooves 721, 722, and 723, and the grooves 721, 722, and 723 have almost the same sectional area.

In the coil unit 610 shown in FIG. 22 utilizing the coil bobbin 710A and holding member 720B, the wires of the coils 621 to 632 can be extracted from the grooves 721, 722, 723, and 724 of the holding member 720B.

This will be explained in more detail. One-side ends (high-voltage side in this case) of the coils 621, 622, and 623 serving as the end P21 shown in FIG. 23 in the coil group P are guided to the hollow by the notch 715*a*, pass through the groove 721, and are connected to a connection portion (high-voltage connection portion) which receives power of the high-voltage level out of powers supplied to the first coil group. One-side ends (high-voltage side in this case) of the coils 624, 625, and 626 serving as the end P24 of the coil group Q are guided to the hollow by the notch 715*a*, pass through the groove 721, and are connected to the high-voltage connection portion of the first coil group.

One-side ends (high-voltage side in this case) of the coils 627, 628, and 629 serving as the end P25 of the coil group R are guided to the hollow by the notch 715*b*, pass through the groove 722, and are connected to a connection portion on the high-voltage side of power supplied to the second coil group.

One-side ends of the coils 630, 631, and 632 serving as the end P28 of the coil group S are guided to the hollow by the notch 715*b*, pass through the groove 723, and are connected to a connection portion on the high-voltage side of power supplied to the second coil group.

In the coil unit 610, wires which receive powers of the same level are stored in the same groove. Thus, high-frequency power can be supplied without considering the influence of a magnetic field or the like. Since the number A of coil groups in the coil unit 610 connected as the first, second, and third coil groups is A=3, the number of grooves suffices to be "A+1=4" or more, as described above.

The coil unit 610 utilizing the coil bobbin 710A and holding member 710B shown in FIGS. 25 and 26 is not limited to the above-mentioned coil groups and supply powers, and the combination of wires in grooves is selected in accordance with the power supply level. This is effective especially when, for example, the voltage level of the high voltage side changes, i.e., powers of independent magnitudes are supplied to respective coil groups.

FIGS. 27 to 30 are perspective views for explaining an example of a coil bobbin to be combined with the holding member 520B or 720B shown in FIG. 21 or 25.

Figure 27:
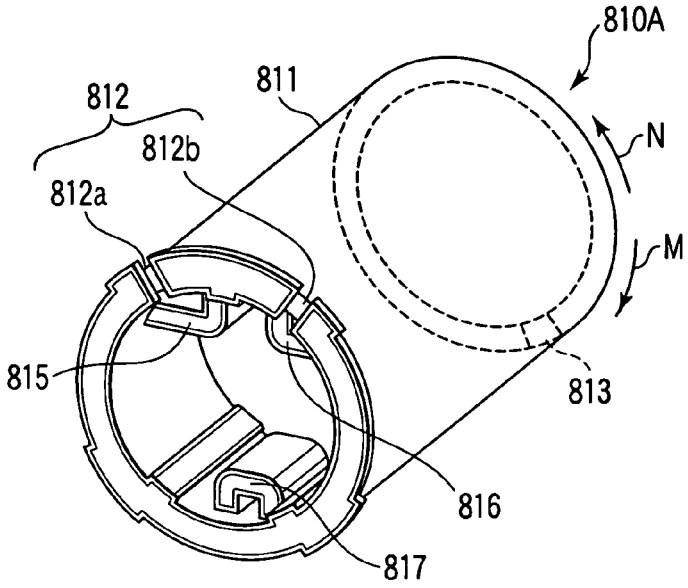
FIG. 27 is a perspective view showing still another example of the coil bobbin.

As shown in FIG. 27, a coil bobbin 810A has a cylindrical shape with a predetermined hollow. The coil bobbin 810A comprises a surface 811 wound with a wire on the outer surface, a notch 812 including notches 812*a* and 812*b* which are formed at one edge of the surface 811, and a notch 813 which is formed at the other edge of the surface 811. The inner surface of the coil bobbin 810A on the hollow side has projections 815, 816, and 817 which are formed in accordance with, e.g., the shapes of the grooves 521, 522, and 523 of the holding member 520B (see FIG. 20). The projections 815, 816, and 817 have a function of restraining movement on the holding member 520B in a direction indicated by an arrow M or N. The projections 815, 816, and 817 can be formed into arbitrary shapes so as to hold a predetermined distance between a wire laid out in each groove and a wire wound around the surface when the coil bobbin 810A is held by the holding member 520B. The projections 815, 816, and 817 can be formed in the longitudinal direction at positions on the inner surface of the coil bobbin that are spaced apart by a predetermined distance from the edge because the end of a wire wound around the surface is guided to the hollow of the coil bobbin.

Figure 29:
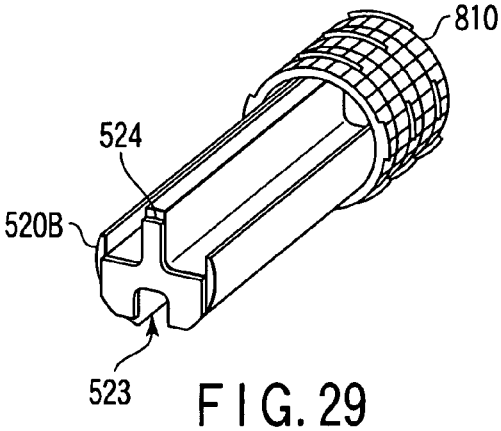
FIG. 29 is a perspective view for explaining a state in which the coil bobbin shown in FIG. 27 is held by the holding member.

The projections 815 and 816 are located in holding so as to sandwich a coil bobbin guide 524 of the holding member 520B described with reference to FIG. 29. The projection 817 is located in holding so as to be fitted in the opening of the groove 523. Thus, the coil bobbin 810A can move in the longitudinal direction along the grooves of the holding member 520B.

Figure 30:
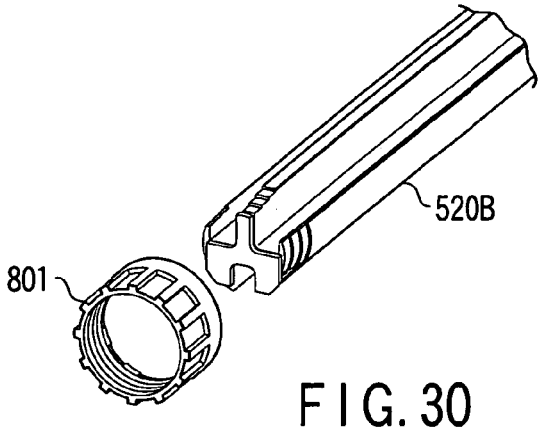
FIG. 30 is a perspective view showing the relationship between the holding member and a stopper.

As shown in FIG. 30, a stopper 801 is attached to the end of the holding member 520B to restrain movement of the coil bobbin 810A in the longitudinal direction of the holding member 520B.

Another example of a coil bobbin to be combined with the holding member 520B will be described with reference to FIG. 28.

Figure 28:
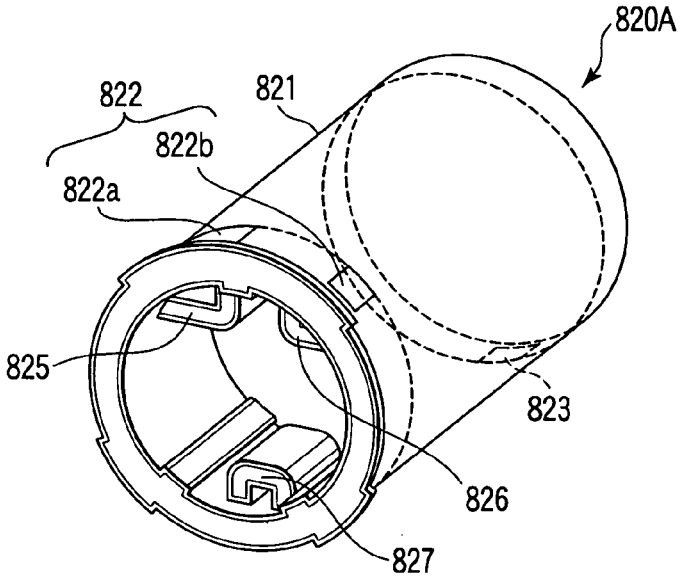
FIG. 28 is a perspective view showing still another example of the coil bobbin.

As shown in FIG. 28, a coil bobbin 820A has a cylindrical shape with a predetermined hollow. The coil bobbin 820A comprises a surface 821 wound with a wire on the outer surface, a hole portion 822 including holes 822*a* and 822*b* which are formed at one end of the surface 821 out of the outer surface, and a hole 823 which is formed at the other end of the surface 821 out of the outer surface. The holes 822*a*, 822*b*, and 823 are used to lay out wires between the surface 821 and the hollow. The holes 822*a*, 822*b*, and 823 can prevent removal of wires wound around the surface 821 from the bobbin while the wires are inserted to the holes 822*a*, 822*b*, and 823.

The inner surface of the coil bobbin 820A on the hollow side has projections 825, 826, and 827 having the same function as that of the projections 815, 816, and 817 formed in the coil bobbin 810A described with reference to FIG. 27.

Figure 31:
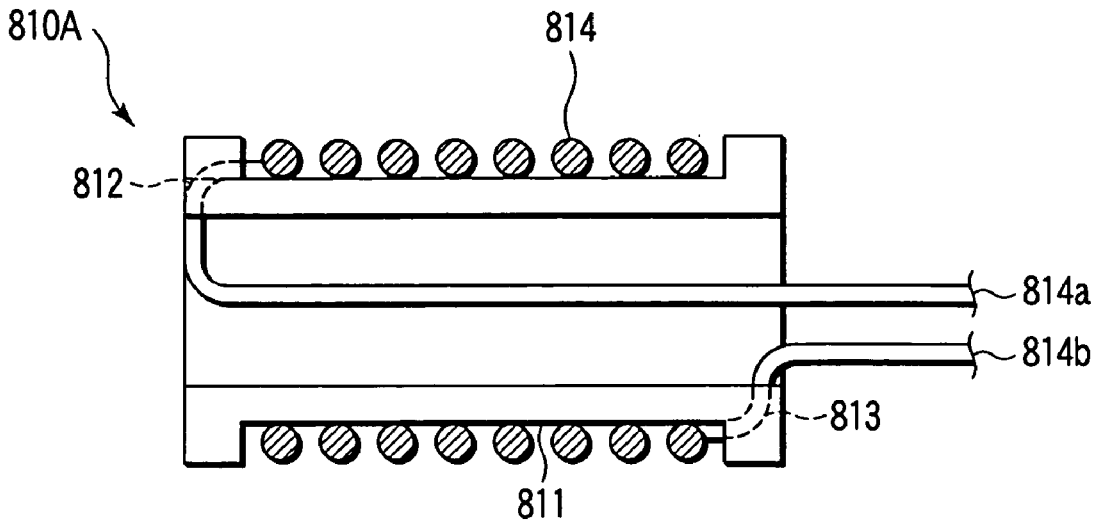
FIG. 31 is a longitudinal sectional view of the coil bobbin shown in FIG. 27.
Figure 32:
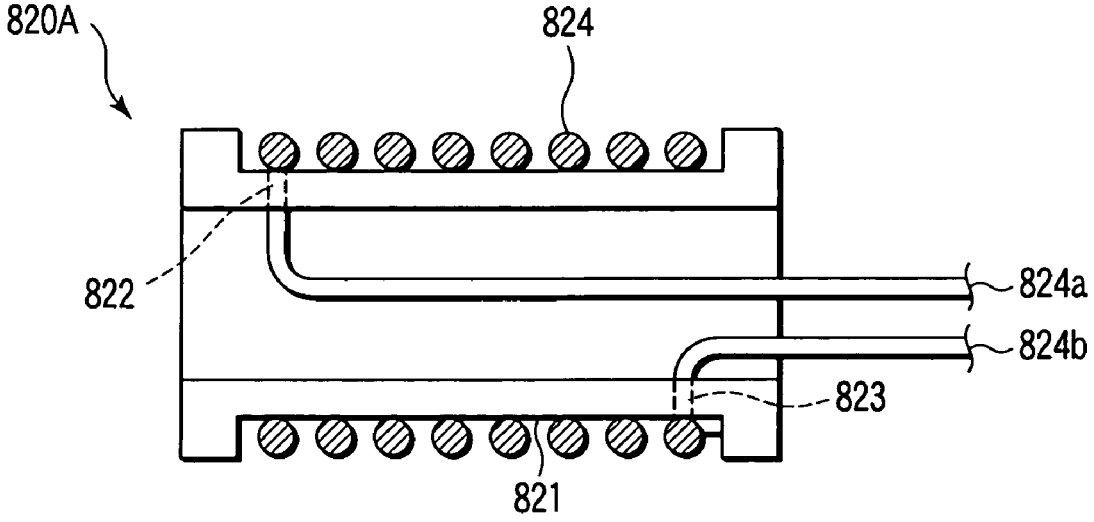
FIG. 32 is a longitudinal sectional view of the coil bobbin shown in FIG. 28.

FIGS. 31 and 32 are longitudinal sectional views showing the coil bobbins 810A and 820A described with reference to FIGS. 27 and 28. The wiring of a coil wound around the coil bobbin 810A or 820A will be explained.

As shown in FIG. 31, the coil bobbin 810A has a wire 814 wound around the surface 811. One end 814*a* is guided to the hollow via either notch 812 (notch 812*a* or 812*b*) formed at the edge. One end 814*a* guided to the hollow and the other end 814*b* guided via the notch 813 formed at the edge are extracted to grooves serving as predetermined wiring paths. Two or one edge of the coil bobbin 810A may have a flange which holds a wire wound around the surface.

As shown in FIG. 32, the coil bobbin 820A has a wire 824 wound around the surface 821. One end 824*a* is guided to the hollow via either the hole 822*a* or 822*b* of the hole portion 822 formed in one end of the surface 821 out of the outer surface. One end 824*a* guided to the hollow and the other end 824*b* guided via the hole 823 formed in the edge are extracted to grooves serving as predetermined wiring paths. The ends 824*a* and 824*b* are extracted from the hollow while passing through the hole 822*a* or 822*b* and the hole 823. The wire can be kept wound around the surface 821.

The coil unit 410 can be formed with an arbitrary array by arbitrarily combining the above-described coil bobbins 510A, 710A, 810A, and 820A and the holding members 520B and 720B.

Figure 33:
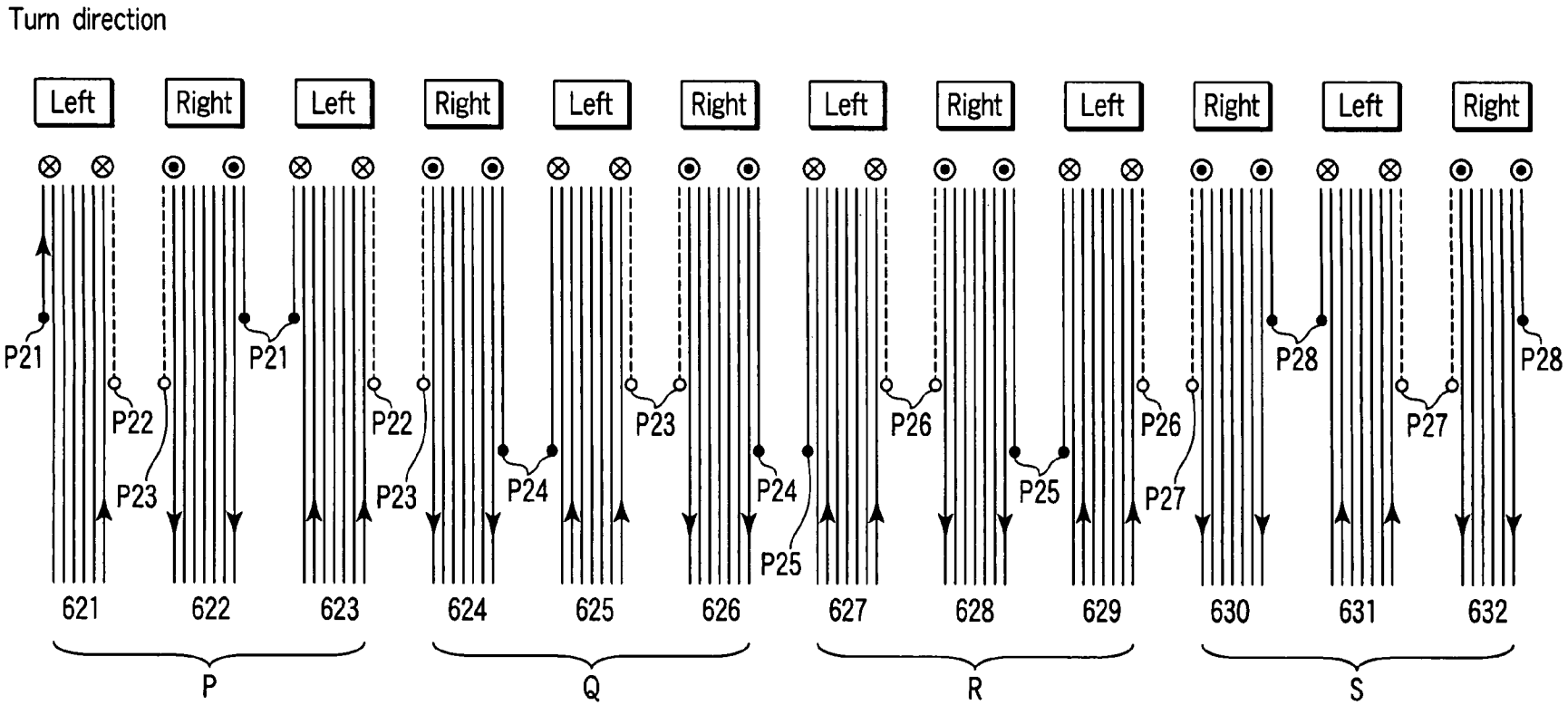
FIG. 33 is a schematic view for explaining in more detail the connection of the coil shown in FIG. 21.

FIG. 33 is a schematic view for explaining in more detail the connection of the coil groups P, Q, R, and S shown in FIG. 22 and the positional relationship of the holding member 520B shown in FIG. 20.

A chain line shown in FIG. 33 corresponds to the groove 523 shown in the sectional view of FIG. 21. As described with reference to FIG. 22, wires which receive the low-voltage (common) powers of the first and second coil groups are laid out together (at once) in the groove 523.

As shown in FIG. 33, powers of almost the same level are supplied to an end at which the coils 621 to 632 are arranged adjacent to each other, in consideration of the influence of magnetic fields generated by adjacent coils. In this case, the coils 621 to 632 are arranged such that the turn directions of adjacent coils become different from each other when viewed from a direction indicated by an arrow F in FIG. 20. As a result, the current flows in the same direction.

As described above, according to the sixth embodiment of the present invention, an insulated wire path is formed in accordance with the current supplied to the lead. The connection to a circuit which supplies a current to the coil can be simplified.

Since wires which receive a low-voltage (common) power are laid out together (at once) in a wire path formed in accordance with the supply power, the coil unit can be downsized and simplified.

What is claimed is:

1. A fixing device comprising:

a core having a plurality of grooves extending in an axial direction;

coil holding bodies each having a hollow cylindrical shape, into which the core is inserted from the axial direction, and covering an outer surface of the core; and a metal body being positioned so as to generate an eddy current in accordance with a magnetic field provided by a coil body;

a power supply device which supplies a voltage and a current at a predetermined frequency to the coil body; and a press member which provides a predetermined pressure to the metal body, wherein the core holds the coil holding bodies, wherein two coil leads wound around each of the coil holding bodies are connected to the power supply device through different grooves, and wherein potentials of the two coil leads running through the different grooves are equal.

2. A device according to claim 1, wherein the coil holding bodies each has a notch through which a coil passes, at a position corresponding to the groove of the core.

3. A device according to claim 1, wherein the number of grooves of the core is the number of circuits+1.

4. A device according to claim 1, wherein a sectional area of a groove in which a common side of the same circuit is set is larger than a sectional area of a remaining groove.

5. A device according to claim 1, wherein a groove in which a non-common side of the same circuit is set is independent for each circuit.

6. A fixing device comprising:

a core having a plurality of grooves extending in an axial direction;

a plurality of coil holding means each having a hollow cylindrical shape, into which the core is inserted from the axial direction, and covering an outer surface of the core; and metal body means for generating an eddy current in accordance with a magnetic field provided by a coil body;

power supply means for supplying a voltage and a current at a predetermined frequency to the coil body; and pressing means for providing a predetermined pressure to the metal body means, wherein the core holds the coil holding means, wherein two coil leads wound around each of the coil holding means are connected to the power supply means through different grooves, and wherein potentials of the two coil leads running through the different grooves are equal.

7. A device according to claim 6, wherein each of the coil holding means has a notch through which a coil passes, at a position corresponding to the groove of the core.

8. A device according to claim 6, wherein the number of grooves of the core is the number of circuits+1.

9. A device according to claim 6, wherein a sectional area of a groove in which a common side of the same circuit is set is larger than a sectional area of a remaining groove.

10. A device according to claim 6, wherein a groove in which a non-common side of the same circuit is set is independent for each circuit.

11. A method of manufacturing a fixing device, comprising:

providing a core having a plurality of grooves extending in an axial direction;

inserting the core from an axial direction into coil holding bodies each having a hollow cylindrical shape, and covering an outer surface of the core;

positioning a metal body so as to generate an eddy current in accordance with a magnetic field provided by a coil body, supplying, by way of a power supply device, a voltage and a current at a predetermined frequency to the coil body;

providing a predetermined pressure to the metal body;

connecting the coil holding bodies to the power supply device through different grooves; and winding two coil leads around each of the coil holding bodies, wherein the core holds the coil holding bodies, and wherein potentials of the two coil leads running through the different grooves are equal.

12. A method according to claim 11, further comprising:

creating a notch in each of the coil holding bodies through which a coil passes, at a position corresponding to the groove of the core.

13. A method according to claim 11, wherein the number of grooves of the core is the number of circuits+1.

14. A method according to claim 11, wherein a sectional area of a groove in which a common side of the same circuit is set is larger than a sectional area of a remaining groove.

15. A method according to claim 11, wherein a groove in which a non-common side of the same circuit is set is independent for each circuit.

* * * * *